US005259654A

United States Patent [19]

Lacey

[11] Patent Number: 5,259,654

[45] Date of Patent: Nov. 9, 1993

[54] SPRING LOADED GRABBING AND HOISTING TONGS

[76] Inventor: William O. Lacey, 1302 E. 68th St., Savannah, Ga. 31404

[21] Appl. No.: 894,870

[22] Filed: Jun. 8, 1992

Related U.S. Application Data

[63] Continuation of Ser. No. 747,244, Aug. 19, 1991.

[51] Int. Cl.[5] ..... B66C 1/42

[52] U.S. Cl. ..... 294/110.1; 294/106

[58] Field of Search ..... 294/16, 28, 19.3, 106, 294/110.1, 118

[56] References Cited

U.S. PATENT DOCUMENTS

| | | | |
|---|---|---|---|
| 596,908 | 1/1898 | O'Neill . | |
| 671,294 | 4/1901 | Pennock | 294/19.3 |
| 714,279 | 11/1902 | Bradford . | |
| 999,603 | 8/1911 | Smith | 294/110.1 X |
| 1,129,664 | 2/1915 | Gilchrist et al. | 294/110.1 |
| 1,132,003 | 3/1915 | Fordyce . | |
| 1,376,414 | 5/1921 | Farnsworth . | |
| 1,452,679 | 4/1923 | Fisher | 294/110.1 X |
| 1,485,972 | 3/1924 | Fitch . | |
| 1,674,967 | 6/1928 | Fitch | 294/68.3 |
| 1,782,326 | 11/1930 | Tornquist . | |
| 1,969,788 | 8/1934 | Fildes | 294/67 |
| 2,348,741 | 5/1944 | Jessen | 294/106 X |
| 2,533,230 | 12/1950 | Dixon | 294/19.3 X |
| 2,562,374 | 7/1951 | Benson | 294/19.3 |
| 2,570,069 | 10/1951 | Novak | 294/28 X |
| 2,829,917 | 4/1958 | Wiora | 294/16 X |
| 3,097,875 | 7/1963 | Kaplan | 294/110.1 X |
| 3,873,145 | 3/1975 | Adkins et al. | 294/118 X |

*Primary Examiner*—David M. Mitchell
*Assistant Examiner*—Dean Kramer
*Attorney, Agent, or Firm*—Timmons & Kelly

[57] ABSTRACT

Tongs for the gripping of articles to be displaced and operable between an open relation in which an article to be displaced can be received and a collapsed relation in which a received article is seized between cooperative gripping members for displacement. Comprising the tongs is a pair of L-shaped lifting arms pivotally secured at their upper ends to a central lifting eye. Lower legs of the lifting arms extend parallel and spaced apart from each other and extend to opposite gripping members at their distal ends. The gripping members are biased toward a collapsed relation in which to grip a received article by a pair of oppositely connected springs in tension. Opposing collapse of the lifting arms and gripping members are a pair of trigger arms each laterally secured from an opposite lifting arm and both pivotally secured to an intervening arm-stop which also restricts displacement of the gripping members between the open and collapsed relation of the tongs.

5 Claims, 3 Drawing Sheets

SPRING LOADED GRABBING AND HOISTING TONGS

This application is a continuation of design application Ser. No. 07/747,244 filed Aug. 19, 1991.

BACKGROUND OF THE INVENTION

1. Field of the invention

This invention relates to tong structures for seizing and lifting of articles.

2. Description of related art including information disclosed under 37 CFR §§1.97–1.99.

Tongs and tong-like structures for the retrieval and transfer of articles have been widely used for well over a century. They are available in a variety of structural forms for both general and specific applications. Exemplifying tongs of the prior art are the disclosures of prior U.S. Pat. Nos. 596,908; 1,132,003; 1,376,414; 1,485,972; 1,782,326; and 1,909,788.

In a typical construction, tongs resemble a large scissors with end gripping members extending inward toward each other for gripping or seizing an article. A chain or rope can be connected via a center loop to a hoisting ring. Depending on orientation and method of operation, the tongs can be utilized to lift, seize, or hold an article for retrieval and/or transport.

SUMMARY OF THE INVENTION

The general object of the invention is to provide a novel tongs structure operable between open and collapsed relations for the gripping and hoisting of articles. In general, the object is achieved by a pair of opposite lift arms each being of substantially L-shape and pivotally secured at their upper end to a centrally located lifting eye. In the open orientation of the tongs, each L-shaped arm includes a first leg extending oppositely in a common plane to an offsetting second leg that terminates at its distal end inwardly directed as a prong or other suitable gripping member.

A pair of elongated springs arranged in a crossing pattern are each connected in tension between the first upper leg of one lift arm to the second lower leg of the other lift arm. A pair of aligned trigger arms each laterally extending pivotally secured from the second leg of a respective lift arm are commonly joined at their inner ends to a centrally located arm stop.

With the tongs in a more or less horizontal orientation and in the open relation the arm stop serves to maintain the trigger arms in a near linear relation centrally slightly below center so as to maximize the spread between the lift arms. Placing the tongs in a vertical orientation enables self-weight of the structure to push the trigger arms upwardly over and past center so as to permit the springs to collapse the lift arms and draw the gripping members toward each other. Supplying a draw force such as by a chain or rope secured to the lifting eye, similarly causes the lift arms to be drawn toward each other.

The above, as well as additional objects, features and advantages of the invention will become apparent in the following detailed description.

DESCRIPTION OF THE PREFERRED EMBODIMENT

Figure 1:
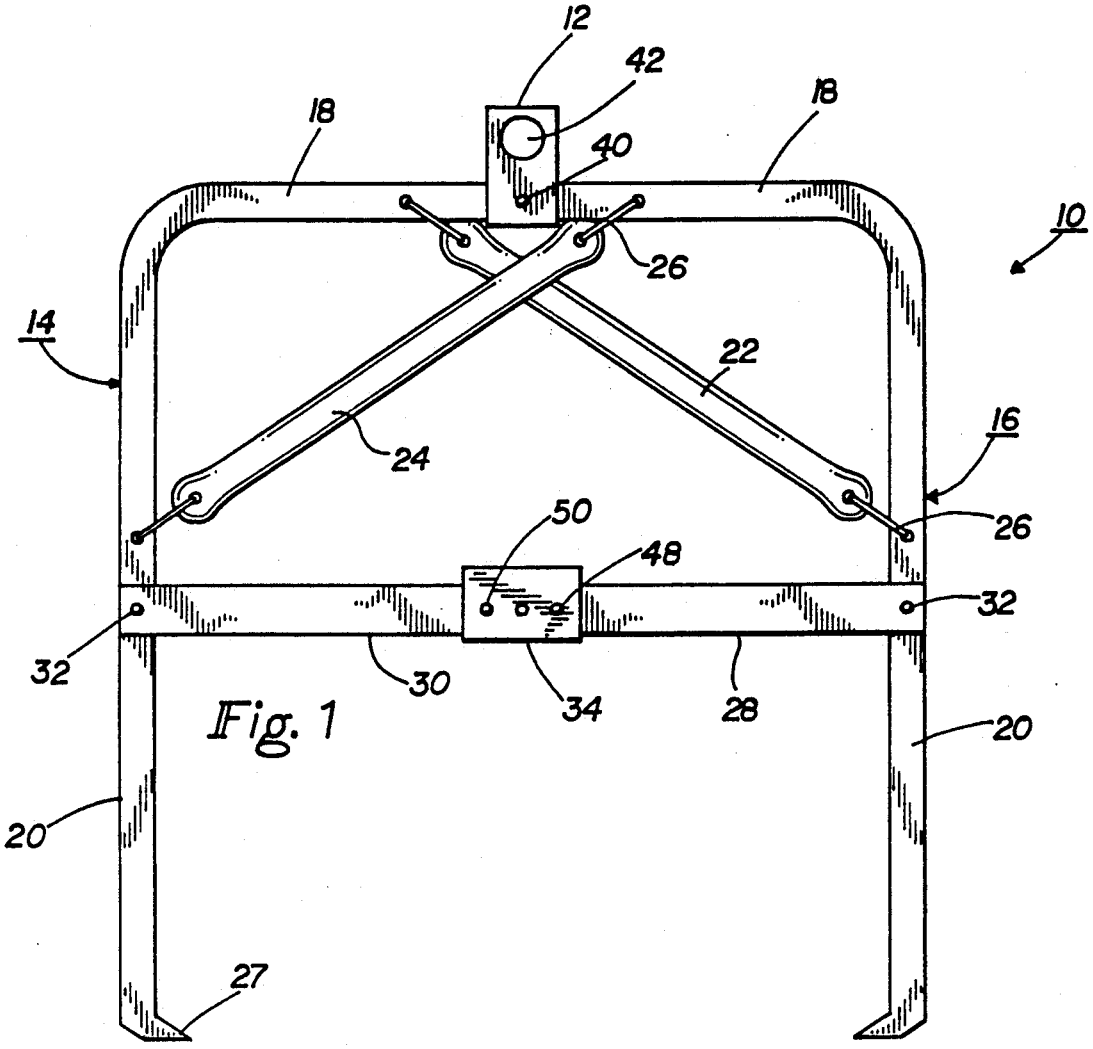
FIG. 1 is a front elevation of the tongs of the invention in open relation.
Figure 2:
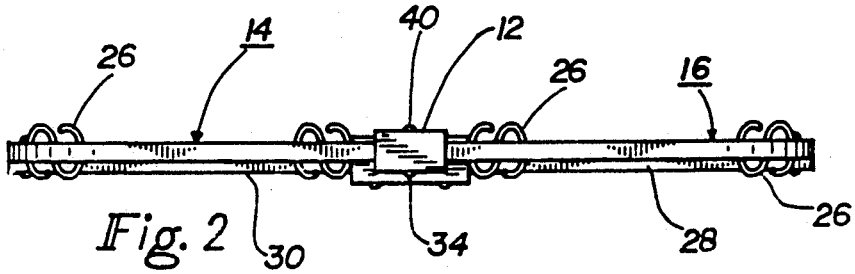
FIG. 2 is a top plan view of the tongs.
Figure 3:
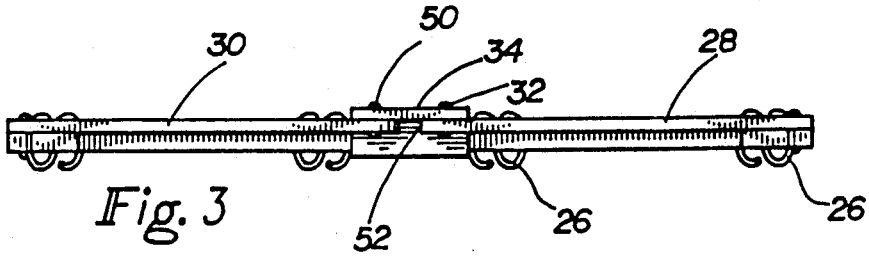
FIG. 3 is a bottom plan view of the tongs.
Figure 4:
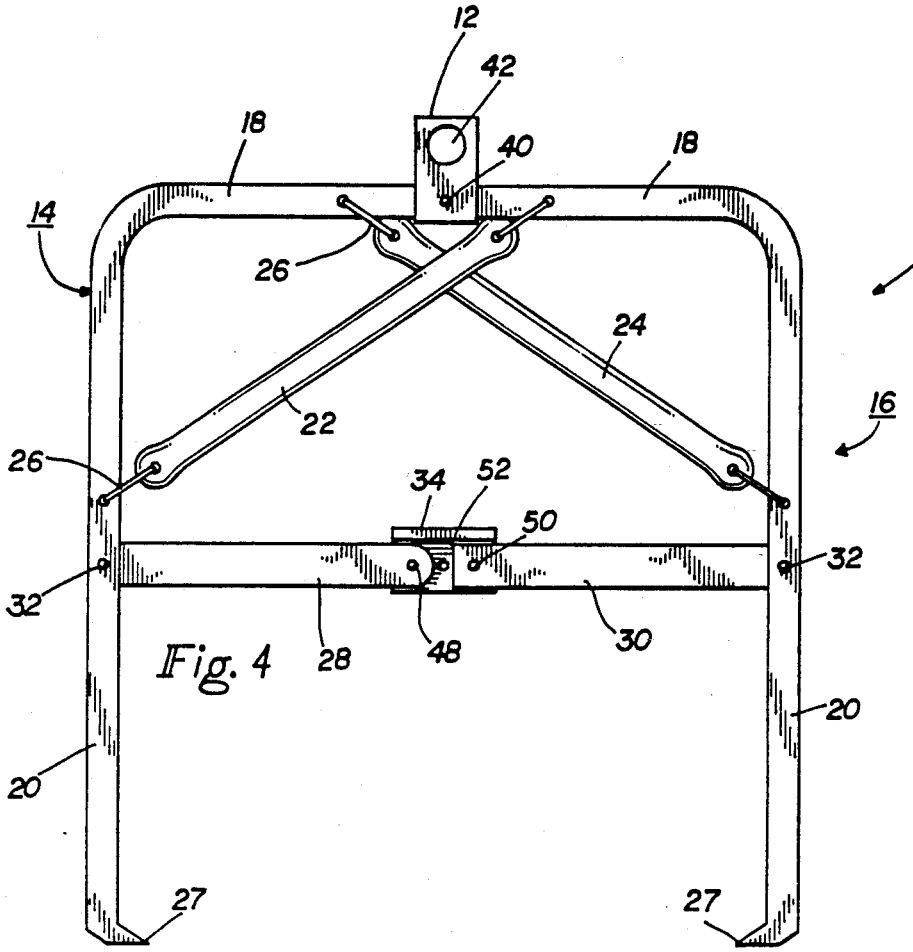
FIG. 4 is a rear elevation of the tongs.
Figure 5:
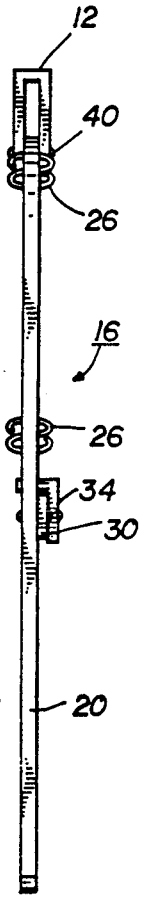
FIG. 5 is a right side elevation of the tongs.

Referring to the drawings, the tongs hereof are designated 10 and include a center lifting eye 12 to which a pair of cooperating and opposite lift arms 14 and 16 are pivotally secured. Each lift arm is L-shaped and both include a coplanar first leg 18 extending when in the open relation oppositely rectilinear from the eye. Offset depending second legs 20 extend spaced apart and parallel to each other. At the terminal distal end of each second leg is an inwardly pointed gripping prong 27 or other suitable gripping structure adapted to grip or minimally penetrate an article to be retrieved or lifted.

Urging collapse of the opposite lift arms toward each other are a pair of elongated elastomeric springs 22 and 24. The springs are arranged in a crossing pattern and are secured tensioned at each of their ends by an S hook 26. In this arrangement, the first leg 18 of one lift arm is connected via a spring to the second leg 20 of the other lift arm.

Opposing the biasing force of the springs 22 and 24 toward collapse of the tongs are a pair of trigger arms 28 and 30 serving to maintain the open spread between the lift arms until the tongs are to be utilized as will be understood. The individual trigger arms are each pivotally supported from one of the lift arms via a pin 32 and are centrally joined in a toggle relation to a central arm stop 34. In this relation, with the lift arms spread apart, the arm stop positions trigger arms about 10 degrees below center. When the tongs are to be utilized, the trigger arms are caused to pass through center in the course of collapsing the spread between the lift arm prongs 27. Inward displacement of the prongs 27 during collapse is limited, as will be explained.

Figure 6:
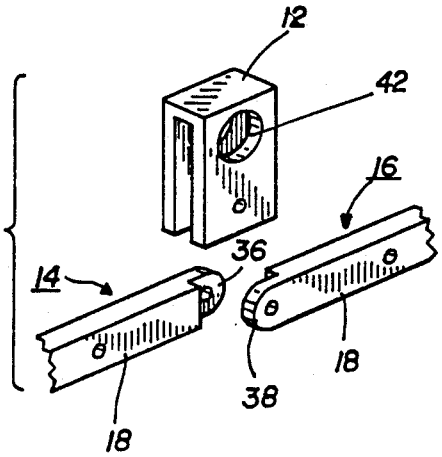
FIG. 6 is an exploded fragmentary isometric view of the lift arm-eye joinder of FIG. 1.

As best seen in FIG. 6, lift eye 12 is comprised of a clevis yoke in which to receive the overlapping tongue ends 36 and 38 of the opposite lift arms to be secured pivotally thereat via a cross pin 40. A through aperture 42, near the upper end of the clevis enables receipt of a draw force via a rope or chain or even a finger.

Figure 7:
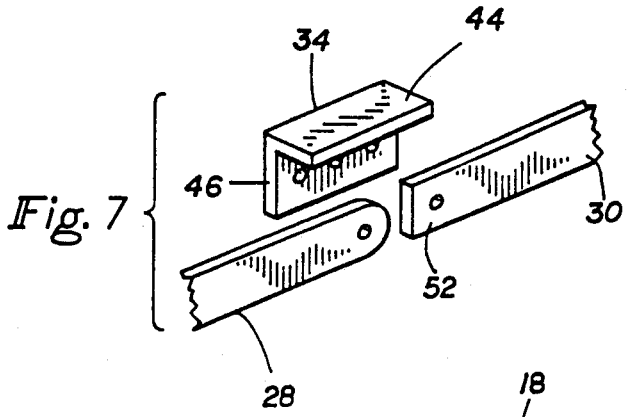
FIG. 7 is an exploded fragmentary isometric view of the trigger arm-stop joinder of FIG. 1.

The arm stop 34 is best seen in FIG. 7 and is comprised of an angle section that includes a horizontal upper ledge 44 and a vertical leg 46. Located in the vertical leg are three spaced-apart apertures the outside ones of which-are adapted to receive pins 48 and 50 to secure the distal ends of trigger arms 28 and 30 respectively. Inward displacement of the prongs 27 in the course of collapsing the tongs is limited by engagement between the squared distal end 52 of arm 30 when engaging the underside of arm ledge 44 (see FIG. 8). Likewise, outward displacement is limited by engagement between the upper edge of arm 30 and the undersurface of arm stop ledge 44.

Figure 8:
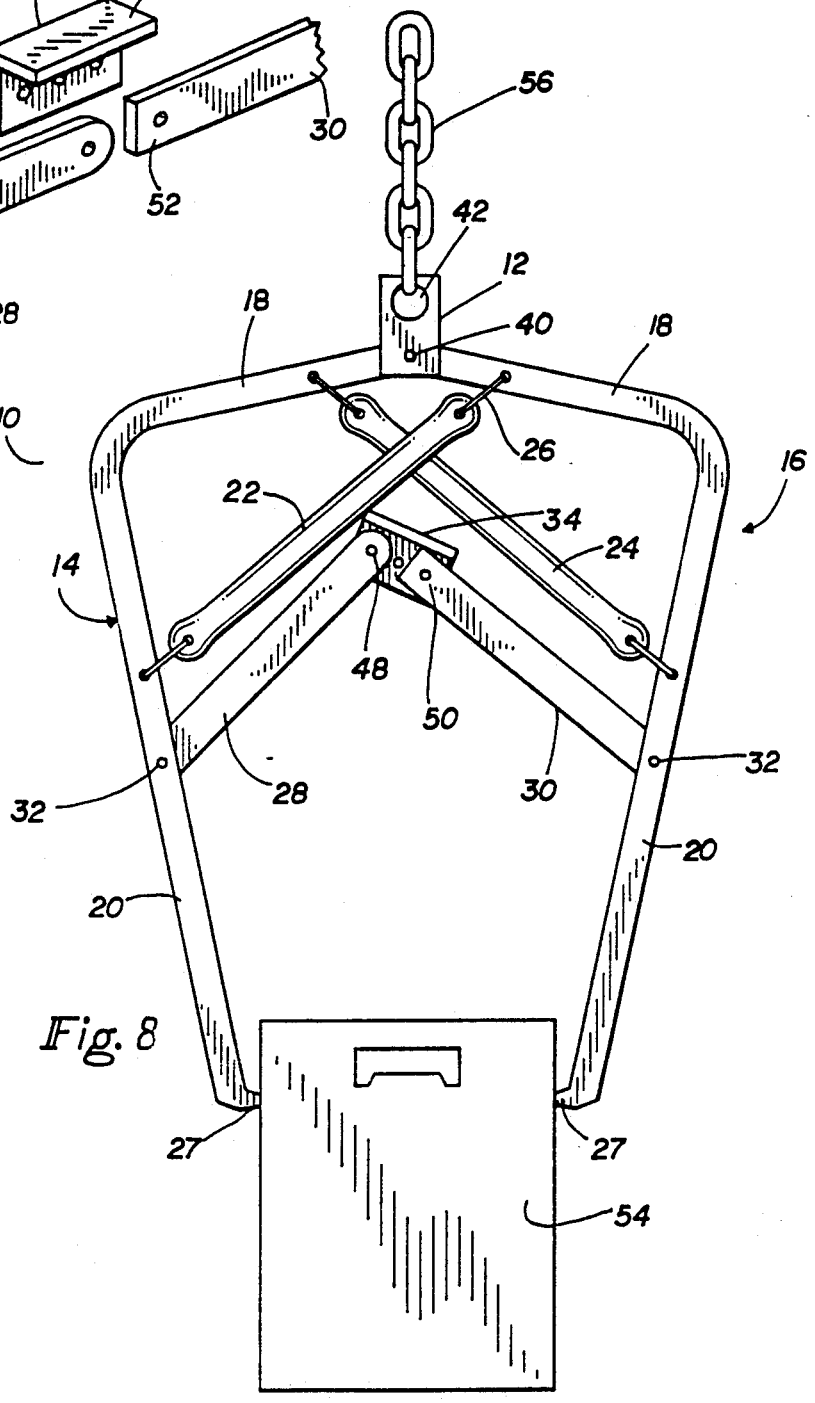
FIG. 8 is a front elevation of the tongs in its collapsed gripping/hoisting relation.

Use of the tongs hereof for seizing a carton or other suitably grasped article 54, can best be understood by reference to FIG. 8. Being constructed of metal or reinforced plastic, the tongs enjoy some amount of self weight. By placing the tongs in a vertical orientation while held at eye 12, the weight thereof effectively pushes the trigger arms 28 and 30 in a toggle relation past center. When this occurs, the tensioned springs 22 and 24 act to draw the lower legs toward each other until stopped by engagement between the distal corner 52 of trigger arm 30 and the underside of arm-stop ledge 44. In the course of being displaced, the prongs 27 are enabled to grasp the article 54 previously received therebetween. With a rope or chain 56 secured in aperture 42 the article can conveniently be hoisted and transported to a suitable destination. Where used for retrieval, as from a horizontal bin, the tongs can be oriented horizontally and caused to collapse by drawing on eye aperture 42.

Being that the tongs hereof are convenient to use, a considerable saving is realized in both time and labor enabling one person to retrieve and dispose of various, articles with minimal effort.

Since many changes could be made in the above construction and many apparently widely different embodiments of this invention could be made without departing from the scope thereof, it is intended that all matter contained in the drawings and specification shall be interpreted as illustrative and not in a limiting sense.

I claim:

1. Tongs for the gripping of articles to be displaced and operable between an open relation in which an article to be displaced can be received and a collapsed relation in which a received article is gripped for displacement, said tongs comprising:

a lifting eye;

a pair of lifting arms secured to said lifting eye for pivotal displacement between said open and collapsed relations;

each of said lifting arms being of substantially L-shaped configuration with an upper leg of each lifting arm being secured to said lifting eye for pivotal displacement relative to an upper leg of the other lifting arm and extending to a lower depending leg terminating at a distal end having a defined gripping means thereon;

a pair of trigger arms each pivotally secured to one of said lifting arms and when in said open relation laterally extending therefrom toward each other to distal ends opposing and spaced apart;

an arm stop disposed intervening between the distal ends of said trigger arms for pivotally supporting the trigger arms to restrict displacement of said trigger arms and said lifting arms between said open and collapsed relations, wherein said arm stop is of angled cross section and said restricted displacement is effected by cooperative engagement between a ledge of said arm stop and an edge of at least one trigger arm thereat; and spring means including a pair of individual springs arranged in a relative cross pattern with each spring being secured in tension between the upper leg of one lifting arm to the lower leg of the other lifting arm so as to urge the gripping means of said lifting arms toward the collapsed relation of said tongs for gripping a received article therebetween, wherein said spring means is a pair of elongated elastomeric springs secured in tension between the respective lifting arms.

2. Tongs in accordance with claim 1 in which the distal ends of said trigger arms are each pivotally supported on said arm-stop on separate axes spaced apart from each other.

3. Tongs in accordance with claim 2 in which said trigger arms are operably effective during said open relation in opposition to the forces of said spring means and in the absence of a collapsing draw force being applied to said lifting eye to maintain the open relation of said tongs.

4. Tongs in accordance with claim 2 in which said gripping means comprises a lateral prong at the distal end of each lifting arm cooperatively able to penetrate minimally the opposite sides of a carton to be gripped.

5. Tongs in accordance with claim 1, wherein when the lifting arms are in the open relation, the arm stop positions the distal ends of the trigger arms below the points at which the trigger arms are secured to the lifting arms.

* * * * *